US005501187A

United States Patent [19]

Speil et al.

[11] Patent Number: 5,501,187

[45] Date of Patent: Mar. 26, 1996

[54] CONNECTION OF A GUIDE RAIL OF A VALVE ACTUATION DEVICE WITH A CAMSHAFT BEARING

[75] Inventors: Walter Speil, Ingolstadt; Arndt Ihlemann; Johann Kecker, both of Herzogenaurach, all of Germany

[73] Assignee: Ina Walzlager Schaeffler KG, Germany

[21] Appl. No.: 406,664

[22] Filed: Mar. 20, 1995

[30] Foreign Application Priority Data

Mar. 24, 1994 [DE] Germany ..... 44 10 122.8

[51] Int. Cl.[6] ..... F01L 1/44; F01L 1/12; F01L 1/24

[52] U.S. Cl. ..... 123/90.22; 123/90.5; 123/90.55

[58] Field of Search ..... 123/90.22, 90.23, 123/90.27, 90.33, 90.34, 90.48, 90.52, 90.5, 90.55

[56] References Cited

U.S. PATENT DOCUMENTS 5,150,672 9/1992 Fischer et al. ..... 123/90.22
5,261,361 11/1993 Speil ..... 123/90.5
5,337,712 8/1994 Reitz ..... 123/90.22

FOREIGN PATENT DOCUMENTS 555853 9/1922 France .

*Primary Examiner*—Weilun Lo
*Attorney, Agent, or Firm*—Bierman and Muserlian

[57] ABSTRACT

A device for the simultaneous actuation of two gas exchange valves (2) of an internal combustion engine comprising a bridge (6) guided movably along a guide rail (8) which, with the interposition of hydraulic valve clearance compensation elements (4), is connected with valve shaft ends (3) of the gas exchange valves (2), a camshaft (16) rotatably supported in the cylinder head (1) by at least one camshaft bearing (15), comprising a bearing block (23) and a bearing cap piece (14) detachably connected thereto and an engine element (12) supporting the guide rail (8) at an upper end thereof, characterized in that the engine element (12) is implemented in one piece with the bearing block (23) and/or the bearing cap piece (14).

5 Claims, 3 Drawing Sheets

CONNECTION OF A GUIDE RAIL OF A VALVE ACTUATION DEVICE WITH A CAMSHAFT BEARING

STATE OF THE ART

A device for the simultaneous actuation of two gas exchange valves of an internal combustion engine comprising a bridge guided movably along a guide rail, whose ends, in particular with the interposition of hydraulic valve clearance compensation elements, are in contact with valve shaft ends of the gas exchange valve, a camshaft rotatably supported in the cylinder head by means of at least one camshaft bearing comprising a bearing block and a bearing cap piece detachably connected thereto, and an engine element supporting the guide rail at an upper end is known for example from FR 555,853. In the device, the guide rail is in the form of a tube in whose alignment is disposed a bolt fastened on the valve cover and engaging the tube. In this way, it is ensured that the guide rail is held securely in its position. In the case of multicylinder engines with a corresponding number of valve covers, the implementation of such valve covers becomes increasingly more expensive and its mounting on the cylinder head is made difficult because the many pins fastened on the cylinder head must be aligned exactly with the guide rails. Otherwise, it is possible that the bolts become tilted during their introduction into the tube ends.

OBJECTS OF THE INVENTION

It is an object of the invention to provide an exact securement of the guide rails before the valve cover is placed onto the cylinder head and to simplify the emplacement of the valve covers.

This and other objects and advantages will become obvious from the following detailed description.

THE INVENTION

The novel device of the invention for the simultaneous actuation of two gas exchange valves (2) of an internal combustion engine comprising a bridge (6) guided movably along a guide rail (8) which, with the inter-position of hydraulic valve clearance compensation elements (4), is connected with valve shaft ends (3) of the gas exchange valves (2), a camshaft (16) rotatably supported in the cylinder head (1) by at least one camshaft bearing (15) comprising a bearing block (23) and a bearing cap piece (14) detachably connected thereto, and an engine element (12) supporting the guide rail (8) at an upper end, is characterized in that the engine element (12) is implemented in one piece with the bearing block (23) and/or the bearing cap piece (14).

In the simplest case, the bearing block or the bearing cap piece comprise an extension which supports the one guide rail. Means on the valve cover for supporting the guide rails are no longer required so that placing them on the cylinder head is simplified.

In the device of the prior art discussed above, a form-fit connection is provided to prevent rotations of the bridge about the guide rail. This form-fit connection is implemented between the bridge and the engine element and can be formed whereby the engine element is provided with a groove parallel to the guide rail which engages a recess formed on the bridge.

In the prior art, the mentioned form-fit connection is formed wherein a second guide implemented as a tube is provided which engages a further bore of the bridge and a bolt fastened on the cylinder head engages a tube end. A further development of such form-fit connection disposed between the bridge and the cylinder head resides therein that on the cylinder head, a rail comprising a groove extending parallel to the guide rail is fixed on the cylinder head and a lug formed on the bridge engaging this groove. The rail can be, for example, a simple flat section screwed to the cylinder head.

It is useful that the engine element connects two adjacent guide rails of two bridges and the engine element can therein comprise a web disposed transversely to the longitudinal axis of the camshaft, adjoining whose web ends bilaterally are integrated arms. The web therein comprises the bearing cap piece or the bearing block. One arm comprises at its end one seat for the associated guide rail while on the other arm, the pins are fastened.

REFERRING NOW TO THE DRAWINGS

Figure 1:
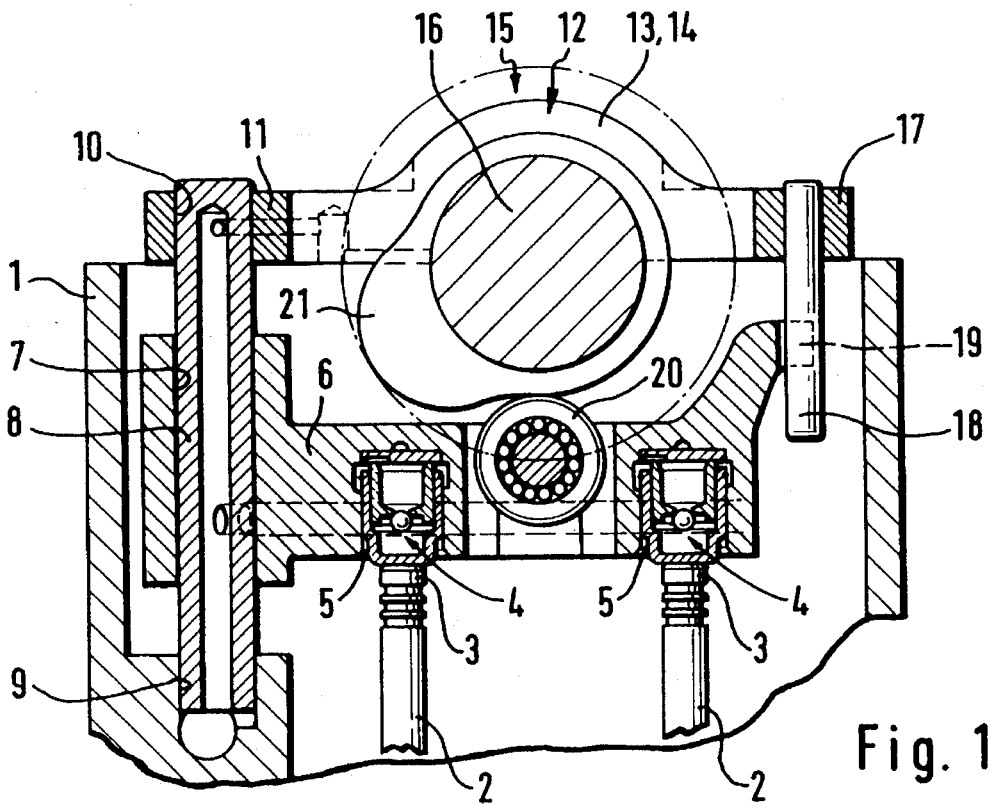
FIG. 1 is a cross-section along line I—I of a device of the invention from FIG. 2.

In FIG. 1, a cylinder head (1) of an internal combustion engine accommodates two gas exchange valves (2) whose valve shaft ends (3) cooperate with hydraulic valve clearance compensation elements (4), each disposed in a recess (5) of a bridge (6). The bridge (6) is provided with a guide bore (7) through which a guide rail (8) is carried. Bridge (6) is guided longitudinally movable along this guide rail (8). The lower end of guide rail (8) is received in a recess (9) of the cylinder head (1) and the upper end of the guide rail (8) is received free to play in a recess (10) of an arm (11) of an engine element (12). A web (13) integrally adjoining the arm (11) forms simultaneously a bearing cap piece (14) of a camshaft bearing (15) of a camshaft (16). The bearing block is secured on the cylinder head (1) in a conventional manner and is not further depicted here. Adjoining the web (13) is an integrally connected arm (17), on which is fastened a pin (18) oriented parallel to the guide rail (8). Pin (18) engages a groove (19) of bridge (6) so that swivel motions of the bridge (6) about the guide rail (8) are not possible.

Between the hydraulic valve clearance compensation elements (4) is provided a roller (20) rotatably supported on bridge (6) for the actuation of the camshaft (16) through a cam (21).

Figure 2:
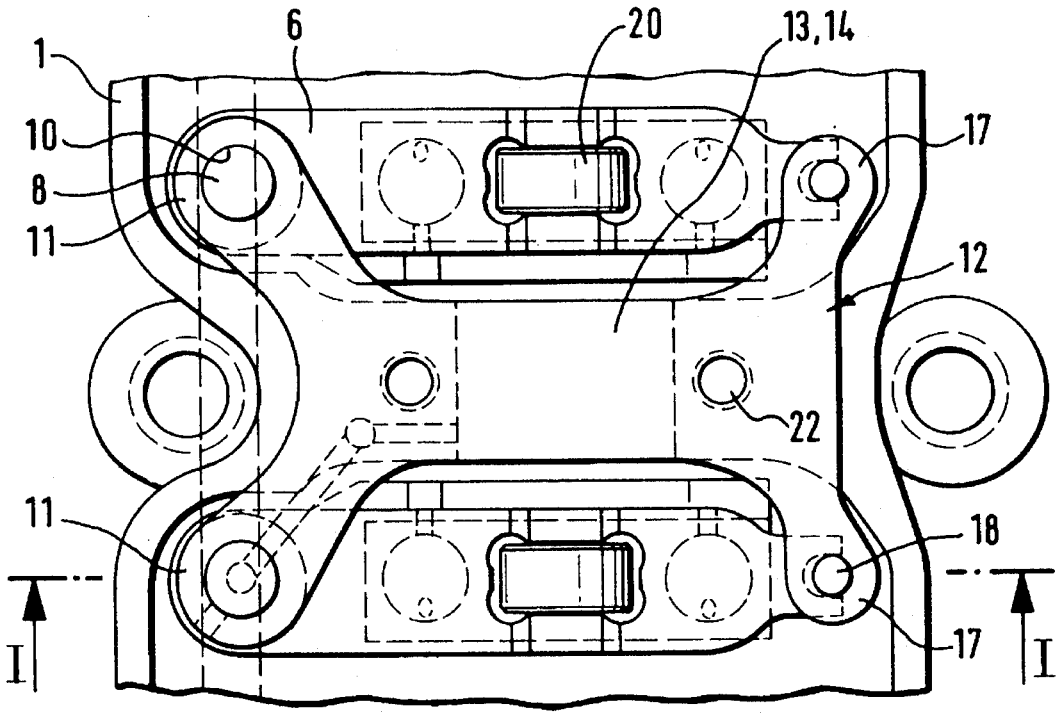
FIG. 2 is a top view onto the device of the invention from FIG. 1.

FIG. 2 is a top view of the device of FIG. 1, without the camshaft. The engine element (12) is connected securely with the cylinder head (1) by a screw connection (22) only indicated here. Based on FIG. 2, it is evident that the engine element (12) is mirrored on a plane transversely on the camshaft axis. Axially adjacent to each camshaft bearing (15) and on both sides is disposed one bridge (6). Arms (11) and (17) are, accordingly, disposed on both sides of web (13).

In the embodiment examples described in the following, the reference numbers used above are accepted for identical parts. The section through the device according to the invention of FIG. 3 corresponds to that of FIG. 1. In contrast to the example described above, not the bearing cap piece but rather a bearing block (23) is formed on the engine element (12). In this embodiment, a separate bearing cap piece (24) is used.

Figure 3:
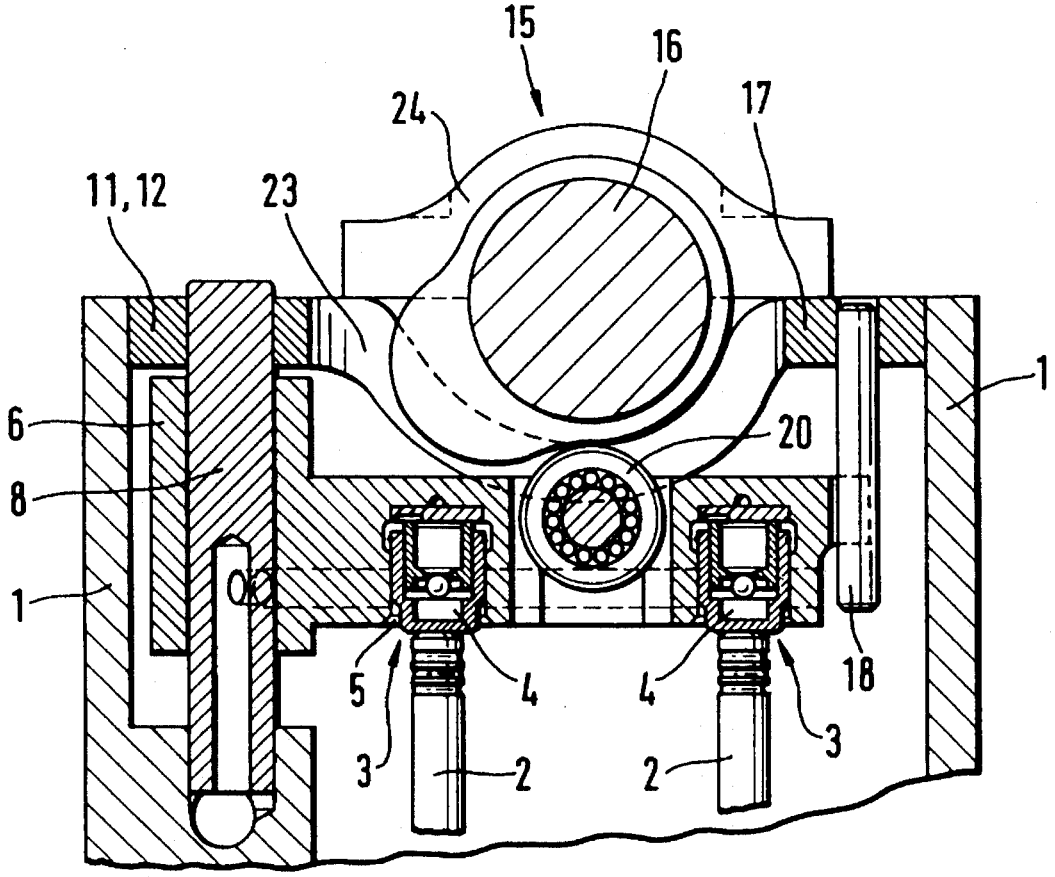
FIG. 3 is a further device of the invention with a section as in FIG. 1.
Figure 4:
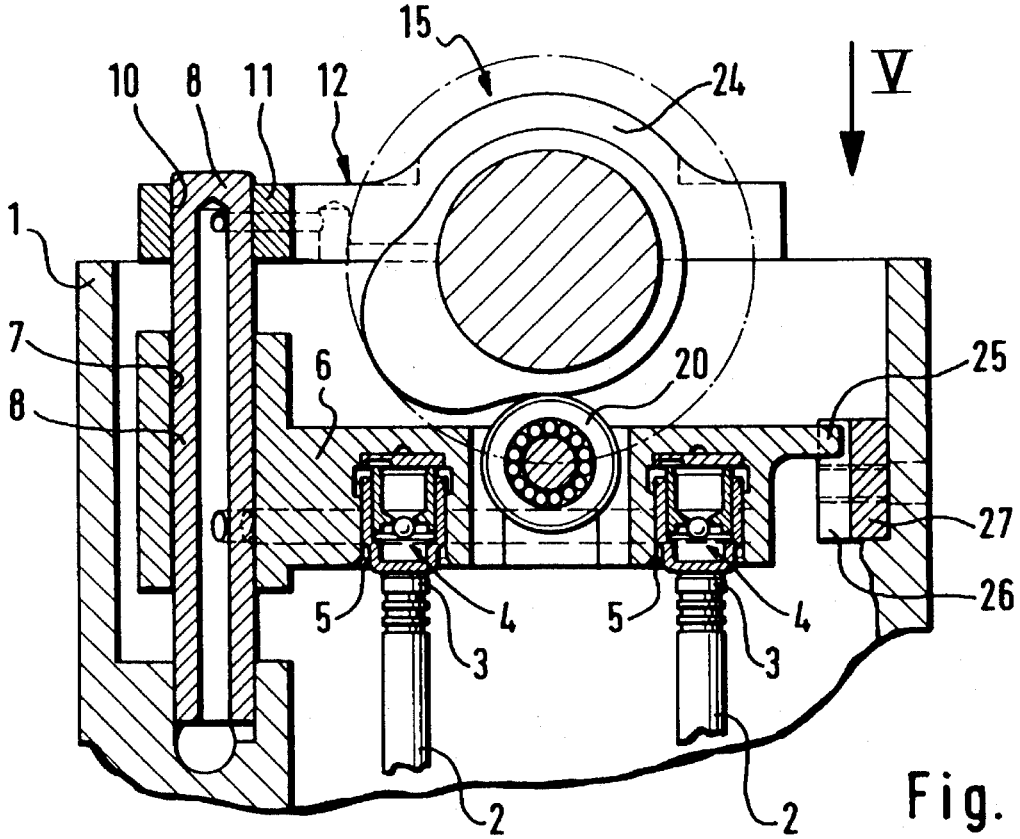
FIG. 4 is a third device of the invention with a section as in FIG. 1.
Figure 5:
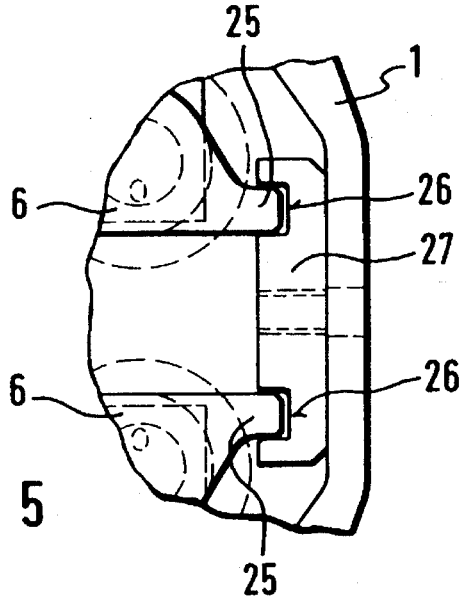
FIG. 5 is in broken representation the top view of the device of the invention from FIG. 4 in the direction of arrow V.

In the embodiment of FIG. 4, the section corresponds to that of FIGS. 1 or 3. In contrast to the embodiments of FIGS. 1 and 2, the securement against twisting of the bridge (6) relative to the guide rail (8) is accomplished in the following way: On the side facing away from the guide rail (8), bridge (6) comprises a projecting lug (25) engaging a groove (26) of a rail (27) fastened on the cylinder head (1). The form-fit connection with respect to a twisting of the bridge (6) relative to the guide rail (8), consequently, is not, as described above, provided between engine element (12) and bridge (6), but rather between cylinder head (1) and bridge (6). The rail (27) is depicted in the top view of the direction of arrow V of FIG. 5. The broken representation shows the ends of the two adjacent bridges (6) and their lugs (25) which engage the grooves (26) of rail (27).

Various modifications of the device of the invention may be made without departing from the spirit or scope thereof and it is to be understood that the invention is intended to be limited only as defined in the appended claims.

What we claim is:

1. A device for the simultaneous actuation of two gas exchange valves (2) of an internal combustion engine comprising a bridge (6) guided movably along a guide rail (8) which, with the inter-position of hydraulic valve clearance compensation elements (4), is connected with valve shaft ends (3) of the gas exchange valves (2), a camshaft (16) rotatably supported in the cylinder head (1) by at least one camshaft bearing (15), comprising a bearing block (23) and a bearing cap piece (14) detachably connected thereto, and an engine element (12) supporting the guide rail (8) at an upper end thereof, characterized in that the engine element (12) is implemented in one piece with the bearing block (23) or the bearing cap piece (14), wherein the bridge (6) comprises a guide bore (7) for the guide rail (8), characterized in that between the bridge (6) and the engine element (12) a form-fit connection (18,19,25,26) is provided to prevent rotation of the bridge (6) about the guide rail (8).

2. A device of claim 1 wherein a pin (18) parallel to the guide rail (8) is provided on the engine element (12) and engages into a recess (19) of the bridge (6).

3. A device of claim 1 wherein a form-fit connection is provided between the bridge (6) and the cylinder head (1) to prevent rotation of the bridge (6) about the guide rail (8), characterized in that a rail (27) comprising a groove (26) extending parallel to the guide rail (8) is fixed on the cylinder head (1) and a lug (25) formed on the bridge (6) engaging this groove (26).

4. A device of claim 1 wherein the engine element (12) connects two adjacent guide rails (8) of two bridges (6).

5. A device of claim 2 wherein the engine element (12) comprises a web (13) disposed transversely to the longitudinal axis of the camshaft (16) and having on both sides of each of its ends integrally formed arms (11,17), and the web (13) comprises the bearing cap piece (14) or the bearing block (23), and each arm (11) of one web end comprises a recess (10) for the associated guide rail (8) while on the arms (17) of the other web end are fastened the pins (18).

* * * * *